US006994277B1

(12) United States Patent
Barnes

(10) Patent No.: US 6,994,277 B1
(45) Date of Patent: Feb. 7, 2006

(54) ACCESSORY FOR FAUCET

(76) Inventor: Roger A. Barnes, 14292 N. 525 Rd., Tahlequah, OK (US) 74464

( * ) Notice: Subject to any disclaimer, the term of this patent is extended or adjusted under 35 U.S.C. 154(b) by 0 days.

(21) Appl. No.: 10/988,134

(22) Filed: Nov. 15, 2004

(51) Int. Cl.
*A62C 31/00* (2006.01)
*A62C 31/02* (2006.01)

(52) U.S. Cl. ..... 239/436; 239/437; 239/447; 239/391; 239/396; 137/625.3

(58) Field of Classification Search ..... 239/436, 239/437, 447, 391, 396, 390, 392, 394, 395, 239/445, 448, 449, 455, 518; 137/625.3, 137/625.33, 625.28; 251/206
See application file for complete search history.

(56) References Cited

U.S. PATENT DOCUMENTS 1,193,086 A * 8/1916 Thomsen ..... 239/436
2,314,357 A * 3/1943 Lehman ..... 210/449
2,382,066 A * 8/1945 Klein ..... 239/436
2,416,737 A * 3/1947 Budan ..... 239/447
3,136,570 A 6/1964 Lee
4,516,606 A * 5/1985 Worley ..... 137/625.3
D291,235 S 8/1987 Bergmann et al.
4,934,402 A 6/1990 Tarnay et al.
4,971,112 A 11/1990 Knapp
5,184,642 A 2/1993 Powell
5,349,987 A 9/1994 Shieh
5,365,958 A 11/1994 Stuhlmacher, II
5,746,415 A * 5/1998 Shimizu ..... 251/208
6,460,783 B1 * 10/2002 Christopher ..... 239/394

* cited by examiner

*Primary Examiner*—David A. Scherbel
*Assistant Examiner*—Darren Gorman
(74) *Attorney, Agent, or Firm*—Donald R. Schoonover

(57) ABSTRACT

An accessory is easily attached to a faucet and is easily manipulated to increase the pressure of water flowing from the faucet. The accessory includes two plates, one of which is movable relative to the other one. Each plate has a plurality of water flow holes through which water from the faucet can flow. In one position, water from the faucet will flow through only one hole, thereby having a high pressure; while in a second position, water can flow through a plurality of holes thereby having a lower pressure. A handle is provided to move one plate with respect to the other plate.

2 Claims, 1 Drawing Sheet

ACCESSORY FOR FAUCET

BACKGROUND OF THE INVENTION

1. Field of the Invention

The present invention relates to the general art of sinks, and to the particular field of accessories for sink faucets.

2. Description of the Related Art

After using a sink to shave, to brush teeth, or the like, many people like to clean either the sink itself or the device used. A stream of water is generally used to effect this cleaning.

However, in order to efficiently clean a razor, or a toothbrush or the sink, the stream of water should be more powerful than the normal stream of water. To this end, many people either turn the water flow up or place their finger over the faucet to increase the pressure of the water flowing out of the faucet. While this is somewhat effective, it is not entirely satisfactory.

Therefore, there is a need for an accessory that can be used to increase the pressure of water flowing from a faucet.

While some kitchen sinks have spray nozzles, such devices are not satisfactory for use with a bathroom sink. Still further, such devices are not designed to be used for the cleaning process described above.

Therefore, there is a need for an accessory that can be used to increase the pressure of water flowing from a faucet of a bathroom sink.

While such an accessory is desirable, it should be easily attached and retro-fit onto an existing faucet to be most effective. If the accessory is difficult or expensive to install, it will not be commercially successful.

Therefore, there is a need for an accessory that can be easily installed and used to increase the pressure of water flowing from a faucet of a bathroom sink.

Still further, once installed, the accessory should be easy to use. Since the accessory will be used by young children as well as older people who may not have full control of their hands, if the device is difficult to use, it will not be successful.

Therefore, there is a need for an accessory that can be easily installed and easily used to increase the pressure of water flowing from a faucet of a bathroom sink.

Some accessories associated with kitchen sinks may be messy if they are not properly used. For example, if a spray nozzle is mis-directed, it can spray water in undesired directions. Since a bathroom sink may be used by people with impaired manual dexterity, such a situation is possible.

Therefore, there is a need for an accessory that can be easily installed and easily, precisely and accurately used to increase the pressure of water flowing from a faucet of a bathroom sink.

Still further, when a person wishes to clean a razor, or a toothbrush, or the sink or the like, that person often simply turns the faucet up as high as it will go. This increases the volume of water flowing through the faucet. However, this may waste water since it is the pressure of the water that is being used to effect the cleaning and not the volume of water. Thus, it is not volume that is desired for this procedure, but water pressure.

Therefore, there is a need for an accessory that can be used to increase water pressure without the need of increasing the flow volume of water flowing from a faucet.

PRINCIPAL OBJECTS OF THE INVENTION

It is a main object of the present invention to provide an accessory that can be used to increase the pressure of water flowing from a faucet.

It is another object of the present invention to provide an accessory that can be used to increase the pressure of water flowing from a faucet of a bathroom sink.

It is another object of the present invention to provide an accessory that can be easily installed and used to increase the pressure of water flowing from a faucet of a bathroom sink.

It is another object of the present invention to provide an accessory that can be easily installed and easily used to increase the pressure of water flowing from a faucet of a bathroom sink.

It is another object of the present invention to provide an accessory that can be easily installed and easily, precisely and accurately used to increase the pressure of water flowing from a faucet of a bathroom sink.

It is another object of the present invention to provide an accessory that can be used to increase water pressure without the need of increasing the flow volume of water flowing from a faucet.

SUMMARY OF THE INVENTION

These, and other, objects are achieved by an accessory for use on a bathroom faucet. The accessory includes two plates, one of which is movable relative to the other one. Each plate has a plurality of water flow holes through which water from the faucet can flow. In one position, water from the faucet will flow through only one hole, thereby having a high pressure; while in a second position, water can flow through a plurality of holes thereby having a lower pressure. A handle is used to move one plate with respect to the other plate.

Using the accessory embodying the present invention will permit a person to easily increase the pressure of water flowing out of the faucet of a bathroom sink to clean devices as well as to clean the sink itself. The accessory is easily installed and easy and accurate to use so it can be used by nearly anyone. A power flow can also be effected without increasing the flow volume of fluid through the faucet thereby conserving water or the like.

BRIEF DESCRIPTION OF THE DRAWING FIGURES

DETAILED DESCRIPTION OF THE PREFERRED EMBODIMENT

Figure 1:
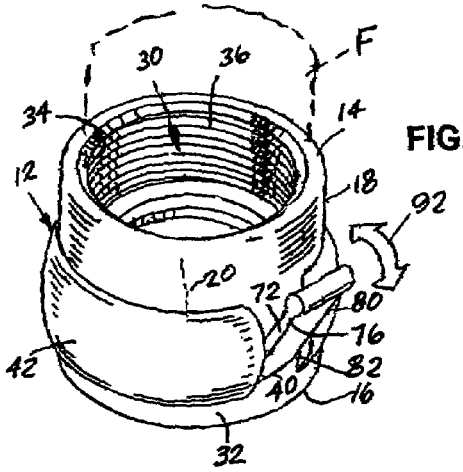
FIG. 1 is a perspective view of a faucet adapter unit embodying the present invention.
Figure 2:
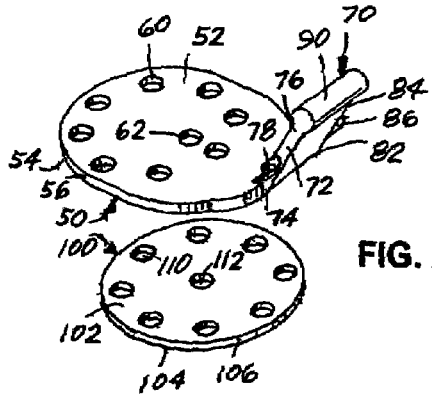
FIG. 2 is a perspective view of two plate elements used in the faucet adapter unit shown in FIG. 1.
Figure 3A:
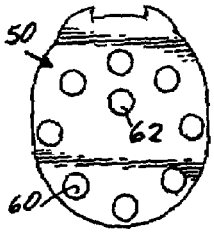
FIG. 3A is a top plan view of one of the two plate elements shown in FIG. 2.
Figure 3B:
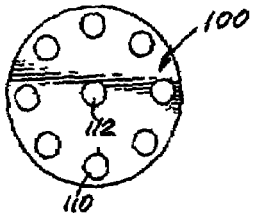
FIG. 3B is a top plan view of one of the two plate elements shown in FIG. 2.

Other objects, features and advantages of the invention will become apparent from a consideration of the following detailed description and the accompanying drawings.

Referring to the Figures, it can be understood that the present invention is embodied in an accessory 10 that can be used on a faucet of a bathroom sink to modify the flow rate and flow pressure of water flowing out of the faucet to achieve the above-stated objectives.

Accessory 10 comprises tubular housing 12 which is attached to an outlet end of a faucet F and which includes a first end 14 which is a proximal end when tubular housing 12 is mounted on a faucet, a second end 16 which is a distal end and which is an outlet end when tubular housing 12 is mounted on a faucet, a cylindrical wall 18 which connects first end 14 to second end 16, and a longitudinal axis 20 which extends between first end 14 and second end 16. Housing 12 is cylindrical and is sized according to the size of the outlet end of a faucet.

A bore 30 is defined between first end 14 and second end 16 with fluid from the faucet flowing through bore 30 when accessory 10 is in use.

Housing 12 further includes an outside surface 32 on wall 18 and an inside surface 34 on the wall 18.

A threaded area 36 is located on inside surface 34 and extends from adjacent to first end 14 toward second end 16. The threaded area 36 is designed to threadably couple housing 12 to the exit end of a faucet in a manner known to those skilled in the art.

A slot 40 is defined through wall 18 adjacent to threaded area 36.

A handle mount 42 is located on outside surface 32 of wall 18 adjacent to slot 40.

A first plate 50 includes a first surface 52 which is an upstream surface when first plate 50 is in use, a second surface 54 which is a downstream surface when first plate 50 is in use, and an outer perimeter 56 connecting first surface 52 to second surface 54.

First plate 50 includes a plurality of flow holes, such as flow hole 60, defined therethrough and which fluidically connect first surface 52 to second surface 54. The plurality of holes defined through first plate 50 further include one centrally located flow hole 62.

A handle 70 is attached to the outer perimeter 56 of the first plate 50 and includes a first arm 72 having a first end 74 attached to outer perimeter 56 of first plate 50, a second end 76 spaced apart from first end 74, and a pivot pin 78 attached to the first arm 72 and pivotally mounted in handle mount 42 of tubular housing 12.

Handle 70 further includes a second arm 80 having a first end 82 attached to outer perimeter 56 of first plate 50, a second end 84 spaced apart from first end 82. A pivot pin 86 is attached to second arm 80 to be co-linear with pivot pin 78 and is pivotally mounted in handle mount 42 of tubular housing 12.

Second arm 80 is spaced apart from first arm 72.

A connecting section 90 connects second end 76 of first arm 72 to second end 84 of second arm 80.

It is to be understood that handle 70 can be one-piece if desired.

Handle 70 is pivotally mounted on handle mount 42 to move in the direction of longitudinal axis 20 of tubular housing 12 as indicated by double-headed arrow 92 between a first position and a second position, with the second position being closer to second end 16 of tubular housing 12 than the first position.

Figure 4:
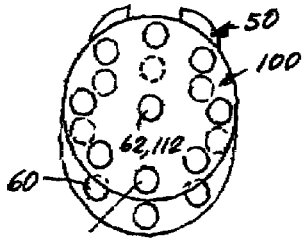
FIG. 4 is a plan view of the two plate elements in a power flow position.
Figure 5:
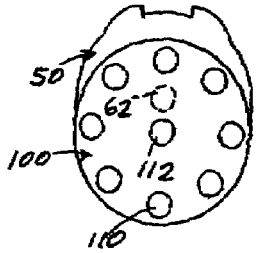
FIG. 5 is a plan view of the two plates in a soft flow position.

First plate 50 is movably mounted on tubular housing 12 to extend across bore 30 and to move in association with handle 70 between a first position shown in FIG. 5 with the flow holes and the centrally located flow hole 62 in a first location, and a second position shown in FIG. 4 with the flow holes and centrally located flow hole 62 in a second position which is spaced apart from the first position.

Accessory 10 further includes a second plate 100 which includes a first surface 102 which is an upstream surface when second plate 100 is in use, a second surface 104 which is a downstream surface when second plate 100 is in use, and an outer perimeter 106 which connects first surface 102 to second surface 104.

Second plate 100 further includes a plurality of flow holes, such as flow hole 110, defined therethrough and which fluidically connect first surface 102 to second surface 104. Second plate 100 further includes one centrally located flow hole 112.

Second plate 100 is mounted on tubular housing 12 to extend across bore 30 and is located adjacent to first plate 50.

As can be understood from FIGS. 4 and 5, flow holes 60 defined through first plate 50 are aligned with flow holes 110 defined through second plate 100 to fluidically connect first surface 52 of first plate 50 to second surface 104 of second plate 100 via the aligned flow holes when first plate 50 is in the first position shown in FIG. 5. In the first position, centrally located flow hole 62 of first plate 50 is spaced from centrally located flow hole 112 of second plate 100.

As shown in FIG. 4, flow holes 60 defined through first plate 50 are spaced apart from flow holes 110 defined through second plate 100 when first plate 50 is in the second position, and centrally located flow hole 62 of first plate 50 is aligned with centrally located flow hole 112 of second plate 100 to fluidically connect first surface 52 of first plate 50 to second surface 104 of second plate 100 via the aligned centrally located holes when first plate 50 is in the second position.

Since the first position has more flow holes aligned than in the second position of first plate 50, flow pressure of fluid flowing out of a faucet will be lower than when the first plate is in the second position with only two flow holes aligned. For this reason, the first position of first plate 50 can be referred to as the soft flow position and the second position of first plate 50 can be referred to as the power flow position.

Use of accessory 10 can be understood from the teaching of the foregoing disclosure and thus will not be discussed in detail. During normal use of a faucet, handle 70 is placed in a position to orient first plate 50 in the soft flow position shown in FIG. 5 whereby fluid flowing from the faucet flows at a low water pressure. However, if a sink or an element is to be cleaned, handle 70 is moved to move first plate 50 into the power flow position shown in FIG. 4 in which fluid flowing from the faucet must all pass through the aligned central flow holes 62 and 112. Since only two holes are aligned, all of the water that would normally flow through all of the aligned flow holes 60 and 110 must now pass through only two aligned holes. This will increase the water pressure and permit a power cleaning to be effected.

The handle 70 can be locked in either position if desired, and the accessory can be mounted on a swivel so it can be moved with respect to the outlet end of the faucet if desired.

It is understood that while certain forms of the present invention have been illustrated and described herein, it is not to be limited to the specific forms or arrangements of parts described and shown.

What is needed and desired to be covered by Letters Patent is as follows:

1. An accessory for a faucet of a bathroom sink comprising:

(a) tubular housing which includes (1) a first end which is a proximal end when said tubular housing is mounted on a faucet, (2) a second end which is a distal end when said tubular housing is mounted on a faucet, (3) a cylindrical wall connecting the first end to the second end, (4) a longitudinal axis which extends between the first end and the second end, (5) a bore defined between the first end and the second end, (6) an outside surface on the wall, (7) an inside surface on the wall, (8) a threaded area on the inside surface and which extends from adjacent to the first end toward the second end, (9) a slot defined through the wall adjacent to the threaded area, and

(10) a handle mount on the outside surface of the wall adjacent to the slot;

(b) a first plate which includes (1) a first surface which is an upstream surface when said first plate is in use, (2) a second surface which is a downstream surface when said first plate is in use, (3) an outer perimeter connecting the first surface of said first plate to the second surface of said first plate, (4) a plurality of flow holes defined through said first plate and which fluidically connect the first surface of said first plate to the second surface of said first plate, (5) one centrally located flow hole, (6) a handle attached to the outer perimeter of said first plate and including (A) a first arm having a first end attached to the outer perimeter of said first plate, a second end spaced apart from the first end of the first arm, and a pivot pin attached to the first arm and pivotally mounted in the handle mount of said tubular housing, (B) a second arm having a first end attached to the outer perimeter of said first plate, a second end spaced apart from the first end of the first arm, and a pivot pin attached to the second arm to be co-linear with the pivot pin attached to the first arm and pivotally mounted in the handle mount of said tubular housing, (C) the second arm being spaced apart from the first arm, and (D) a connecting section connecting the second end of the first arm to the second end of the second arm, (7) the handle being pivotally mounted on the handle mount of said tubular housing to move in the direction of the longitudinal axis of said tubular housing between a first position and a second position with the second position being closer to the second end of said tubular housing than the first position, and (8) said first plate being movably mounted on said tubular housing to extend across the bore of said tubular housing and to move in association with the handle between a first position with the flow holes and the centrally located flow hole defined through said first plate in a first location and a second position with the flow holes and the centrally located flow hole defined through said first plate in a second position which is spaced apart from the first position;

(c) a second plate which includes (1) a first surface which is an upstream surface when said second plate is in use, (2) a second surface which is a downstream surface when said second plate is in use, (3) an outer perimeter connecting the first surface of said second plate to the second surface of said second plate, (4) a plurality of flow holes defined through said second plate and which fluidically connect the first surface of said second plate to the second surface of said second plate, (5) one centrally located flow hole, and (6) said second plate being mounted on said tubular housing to extend across the bore of said tubular housing and to be located adjacent to said first plate;

(d) the flow holes defined through said first plate being aligned with the flow holes defined through said second plate to fluidically connect the first surface of said first plate to the second surface of said second plate via the aligned flow holes when said first plate is in the first position, the centrally located flow hole of said first plate being spaced from the centrally located flow hole of said second plate when said first plate is in the first position; and (e) the flow holes defined through said first plate being spaced apart from the flow holes defined through said second plate when said first plate is in the second position, the centrally located flow hole of said first plate being aligned with the centrally located flow hole of said second plate to fluidically connect the first surface of said first plate to the second surface of said second plate via the aligned centrally located holes when said first plate is in the second position.

2. An accessory for a faucet comprising:

(a) a housing having a flow bore defined therethrough;

(b) a first plate movably mounted on said housing to extend across the flow bore of said housing, said first plate including (1) a handle, (2) a plurality of flow holes defined therethrough, (3) a central flow hole defined therethrough, and (4) said first plate being movable between a power position and a soft flow position, with the flow holes and the central flow hole of said first plate being in a soft flow position when said first plate is in the soft flow position and the flow holes and the central flow hole of said first plate being in a power flow position when said first plate is in the power flow position;

(c) a second plate mounted on said housing adjacent to said first plate to extend across the flow bore, said second plate including (1) a plurality of flow holes defined therethrough, and (2) a central flow hole defined therethrough; and (d) the flow holes defined through said first plate being aligned with the flow holes defined through said second plate to define a fluid path through said first and second plates via the aligned flow holes when said first plate is in the soft flow position, the central flow hole of said first plate being spaced from the central flow hole of said second plate when said first plate is in the soft flow position; and (e) the flow holes defined through said first plate being spaced apart from the flow holes defined through said second plate when said first plate is in the power flow position, the central flow hole of said first plate being aligned with the central flow hole of said second plate to define a fluid path through said first and second plates via the aligned central flow holes when said first plate is in the power flow position.

* * * * *